United States Patent [19]

Hill

[11] 4,123,109

[45] Oct. 31, 1978

[54] MINING METHOD

[75] Inventor: Bruce S. Hill, Mondeor, South Africa

[73] Assignee: Edenvale Engineering Works (Proprietary) Limited, Johannesburg, South Africa

[21] Appl. No.: 732,198

[22] Filed: Oct. 14, 1976

[30] Foreign Application Priority Data

Oct. 28, 1975 [ZA] South Africa ..... 75/6817

[51] Int. Cl.[2] ..... E21C 27/20

[52] U.S. Cl. ..... 299/13; 299/56; 299/31

[58] Field of Search ..... 175/326, 108; 299/10, 299/18, 56, 57, 31

[56] References Cited

U.S. PATENT DOCUMENTS

| | | | |
|---|---|---|---|
| 1,765,525 | 6/1930 | Davis | 299/18 X |
| 2,940,740 | 6/1960 | Adams | 299/57 |
| 3,167,354 | 1/1965 | Macaul et al. | 299/56 X |
| 3,856,357 | 12/1974 | Wharton | 299/57 |
| 3,897,976 | 8/1975 | Gallis | 299/56 |
| 3,957,305 | 5/1976 | Peterson | 299/18 |

*Primary Examiner*—Ernest R. Purser
*Assistant Examiner*—William F. Pate, III
*Attorney, Agent, or Firm*—Young & Thompson

[57] ABSTRACT

A tabular mineral deposit is mined by drilling overlapping holes in the plane of the deposit, the first hole being drilled in any convenient manner and each subsequent hole being drilled by a box hole type machine with a coring bit. The core breaks up and passes out of the core barrel into the orbit of vanes that transfer the broken rock into the hole being lapped. The broken rock is then removed along the hole being overlapped as by means of a drag line scraper.

1 Claim, 5 Drawing Figures

MINING METHOD

Figure 1:
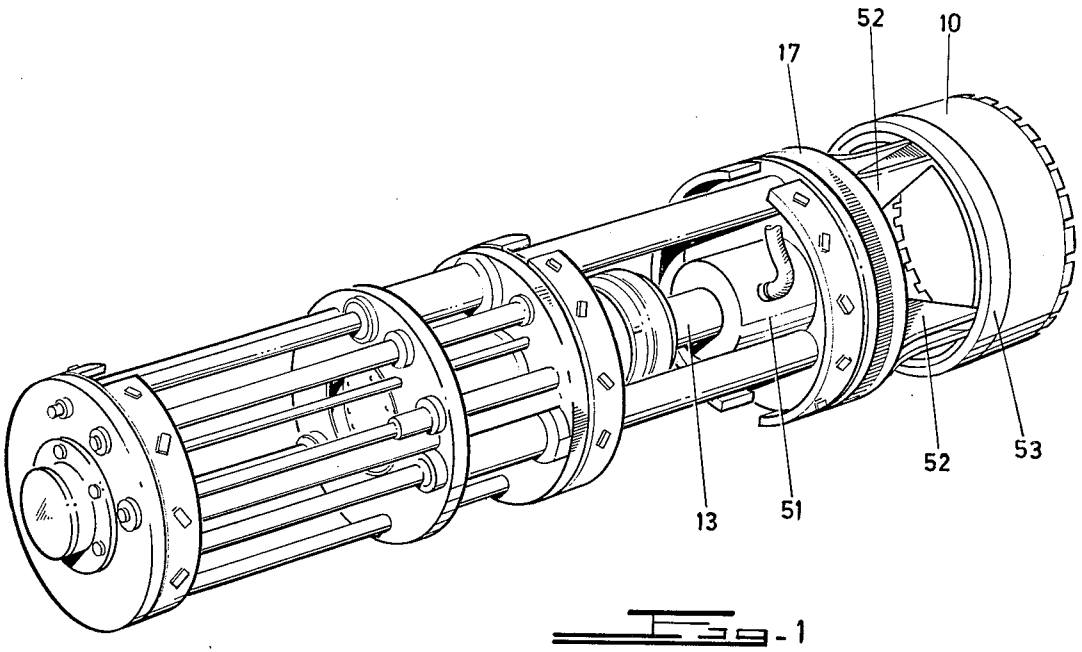

This invention relates to a mining method and apparatus for carrying out that method.

It has already been proposed to mine tabular mineral deposits occurring in narrow veins by drilling overlapping holes between two tunnels in the plane of the vein. The first proposal of this kind seems to be contained in U.S. Pat. No. 3,167,354. In this specification coring drills are used. It should be noted that it is a relatively simple matter to drill overlapping holes by means of core drilling techniques. It has also been proposed to use boxhole machines for drilling overlapping holes — see S.A. Mining and Engineering Journal, April 1975, at page 18, but it is not clear from the latter proposal how the boxhole machine would be prevented from wandering off into a hole being overlapped in S.A. Pat. No. 74/8413 a machine is described which is in essence a boxhole machine with a coring bit. The latter machine is ideal for drilling overlapping holes. Raise borer techniques could also be used for drilling overlapping holes with a view to mining a tabular deposit.

If core making techniques are used, the whole drilling machine has to be withdrawn to the tunnel from which it started out, the core removed and the machine returned to the end of the hole being drilled. If, as happens in highly stressed or friable ground, the core breaks up, it is seldom possible to drill a full core before the return step. Time is thus wasted in moving up and down the hole.

The use of ordinary boxhole machines or raise borer techniques involve the cutting of chips which somehow have to be flushed out of the hole being drilled. The chips have to move past parts of the machine that is forming the hole. This leads to undue wear of those parts and much flushing fluid is required to clear a hole.

According to the invention a method of underground mining consisting of drilling overlapping holes from an underground excavation, such as a tunnel, the mined product being drilled rock, is characterised in that every hole after the first is drilled to provide rock fragments, those fragments after being formed are transferred laterally into the hole being overlapped and the fragments thus transferred are removed along the hole being overlapped.

Any of the machines discussed above can be used for drilling the first hole. For drilling the second and subsequent holes a machine is used which is modified by the addition of a lateral material transferring device immediately behind the cutting head or an open-ended core barrel.

A suitable material transferring device could be a helix or spiral of a suitable hand or simply a series of vanes.

Removal of material along the hole being overlapped can also be effected in a variety of ways. Thus the material can simply be flushed out periodically. Alternatively mechanical conveying devices could be used. Such a device could be a series of strakes that reciprocate in the hole being lapped. If there is a second tunnel, the device could be a drag line scraper working in the hole being overlapped. Note that material removal need not take place to the tunnel that one drills from. If the hole being overlapped is through to another tunnel, one can remove material to the opposite tunnel. Thus, with a sloping vein, drilling in a downward direction is possible with material being removed also in a downward direction to the other tunnel. This may help to conserve drilling fluid.

Figure 3:
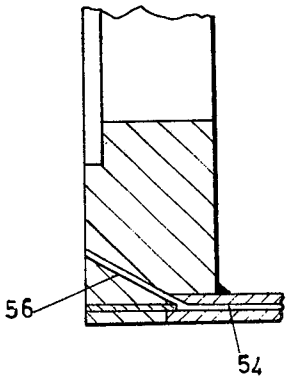
Figure 2:
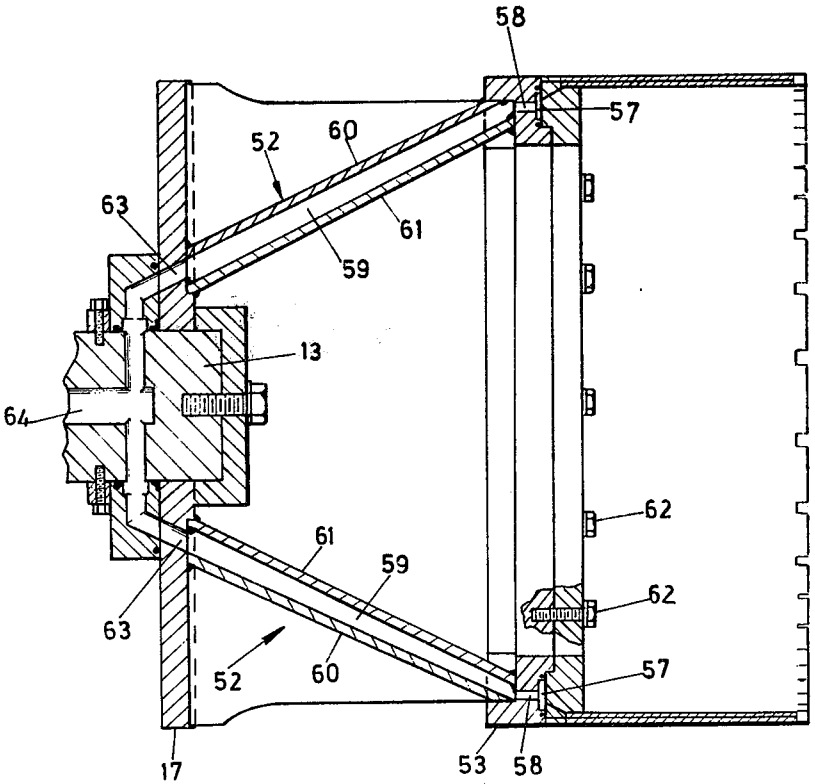
Figures 4, 5:
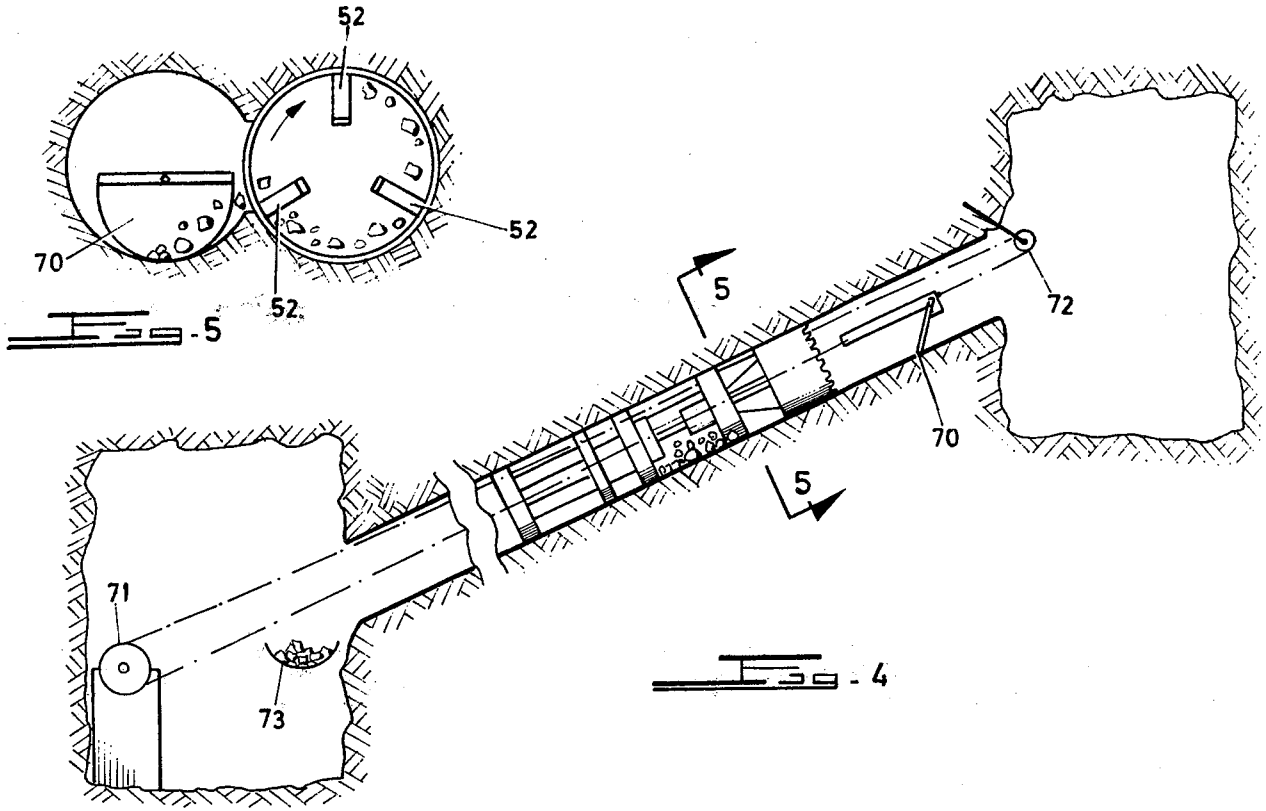

The invention is further discussed with reference to the accompanying drawings, in which FIG. 1 is a perspective view of a machine as described in South African Pat. No. 74/4813 as modified by the present invention, FIG. 2 is an enlarged section of the drill head of FIG. 1, FIG. 3 is an enlarged detail of part of FIG. 2, FIG. 4 is a side view illustrating the method of the invention, FIG. 5 is a on line 5—5 in FIG. 4.

In FIG. 1, the device of South African Pat. No. 74/6730 is shown with the core barrel 10 spaced a distance from the front plate 17. The core barrel 10 is connected to the plate 17 by means of three vanes 52 which are described in detail later on. The plate 17 is carried by a shaft 13 which passes through a water-swivel 51. It will be seen that the core barrel 10 is open-ended. At the front end it is fitted with cutting inserts in the normal manner and at the rear end it has a ring 53 to which the vanes 52 are connected.

The parts behind the plate 17 have been fully described in the complete specification of South African Pat. No. 74/6730 and need no further elaboration here.

In use drilling fluid is fed to the water-swivel 51 and that fluid has to reach the cutting inserts at the front end of the core barrel 10. The manner of achieving this is illustrated in detail in FIGS. 2 and 3.

The core barrel 10 has a series of ducts 54 (FIG. 3) formed in its thickness leading from the rear end to spaces between selected cutting inserts. An annular flange 55 is secured to the inside of the barrel 10 and it has bores 56 communicating with the ducts 54. The flange 55 is secured to the ring 53 by screws 62. The ring 53 on its front face is formed with an annular recess 57 into which the bores 56 mouth. Bores 58 pass through the ring 53 into the recess 57.

Each vane 52 is composed of two plates 60 and 61, which are spaced apart by plates which between them define an enclosed channel 59. Each channel 59 communicates with a bore 63 piercing the front plate 17. The bores 63 in turn communicate as shown with a central bore 64 in the shaft 13. The central bore 64 is fed with fluid from the water swivel 51 in a well-known manner.

In effect then drilling fluid reaches the drilling face from the water swivel 51 via a series of channels ending with the ducts 54.

In use the core drilling inserts cut a kerf to define a core which passes into the barrel 10. Due to rock pressures or the friability of the rock being drilled, this core breaks up and the broken fragments tumble around in the barrel 10, but are forced back by incoming core fragments into the zone of the vanes 52. The vanes 52 fling the fragments out centrifugally and scrape them around on the wall of the hole being drilled. At the overlap with the previously drilled hole, the fragments pass into that hole. (FIG. 5)

In the previously drilled hole there is a drag line scraper 70 which may be pulled to and fro by means of a rope passing around a pulley 72 and around a reversible winch drum 71. Material scraped out of the hole falls into a conveyor 73.

In rock which does not break up during core drilling, the barrel 10 may have to be lengthened and it may have to be fitted with core breaking devices on its inside.

I claim:

1. A method of underground mining for producing a series of overlapping empty cylindrical holes in side-by-side relationship, comprising drilling a first cylindrical hole through rock with a core drill that rotates coaxially in said first hole, and after said first hole is drilled, drilling a second cylindrical hole through said rock with a said core drill in a manner to produce rock fragments, said second hole overlapping said first hole whereby said first and second holes communicate laterally with each other along their length, pushing said rock fragments laterally from said second hole into said first hole immediately as said rock fragments are formed, the region of lateral transfer of said rock fragments from said second hole to said first hole advancing lengthwise along said holes in the direction of drilling of said second hole and immediately behind the advancing bottom of said second hole, passing conveyor means along said first hole with no drilling means in said first hole while drilling said second hole thereby to remove substantially all said rock fragments from said first hole, and repeating the method with third and subsequent holes.

* * * * *